United States Patent [19]

Perry

[11] Patent Number: 4,669,970

[45] Date of Patent: Jun. 2, 1987

[54] HAND TOOL FOR FINISHING CORNERS AND THE LIKE WITH A CEMENTIOUS MATERIAL

[76] Inventor: John F. Perry, 2810 N. 70th St., Scottsdale, Ariz. 85257

[21] Appl. No.: 889,218

[22] Filed: Jul. 25, 1986

[51] Int. Cl.[4] ..... B29C 59/00

[52] U.S. Cl. ..... 425/458; 15/235.7

[58] Field of Search ..... 425/458; 15/235.7, 235.8

[56] References Cited

U.S. PATENT DOCUMENTS

| | | | |
|---|---|---|---|
| 515,890 | 3/1894 | Walrath | 15/235.7 |
| 1,673,941 | 6/1928 | Guarino | 15/235.6 |
| 2,616,285 | 11/1952 | Shields | 15/235.7 |
| 4,230,441 | 10/1980 | Heronema | 425/458 |

*Primary Examiner*—Willard E. Hoag

*Attorney, Agent, or Firm*—James H. Phillips

[57] ABSTRACT

An adjustable handtool is provided for finishing corners, edges and the like with cementious material to effect a uniformly rounded configuration to the corner. The hand tool includes a backing plate having a forward working edge characterized by an indented central portion and forwardly extending legs forming a first obtuse angle. Overlaying the backing plate is a pliable sheet which also has a forward working edge characterized by an indented central portion and forwardly extending legs forming a second obtuse angle which is larger than the first obtuse angle such that the working edge of the pliable sheet extends beyond the working edge of the backing plate. The backing plate is preferably manually bendable to suit an individual craftsman and to obtain a working region which has cooperating curvatures at the working edge of the backing plate, at the working edge of the pliable sheet and as caused by the bend.

10 Claims, 10 Drawing Figures

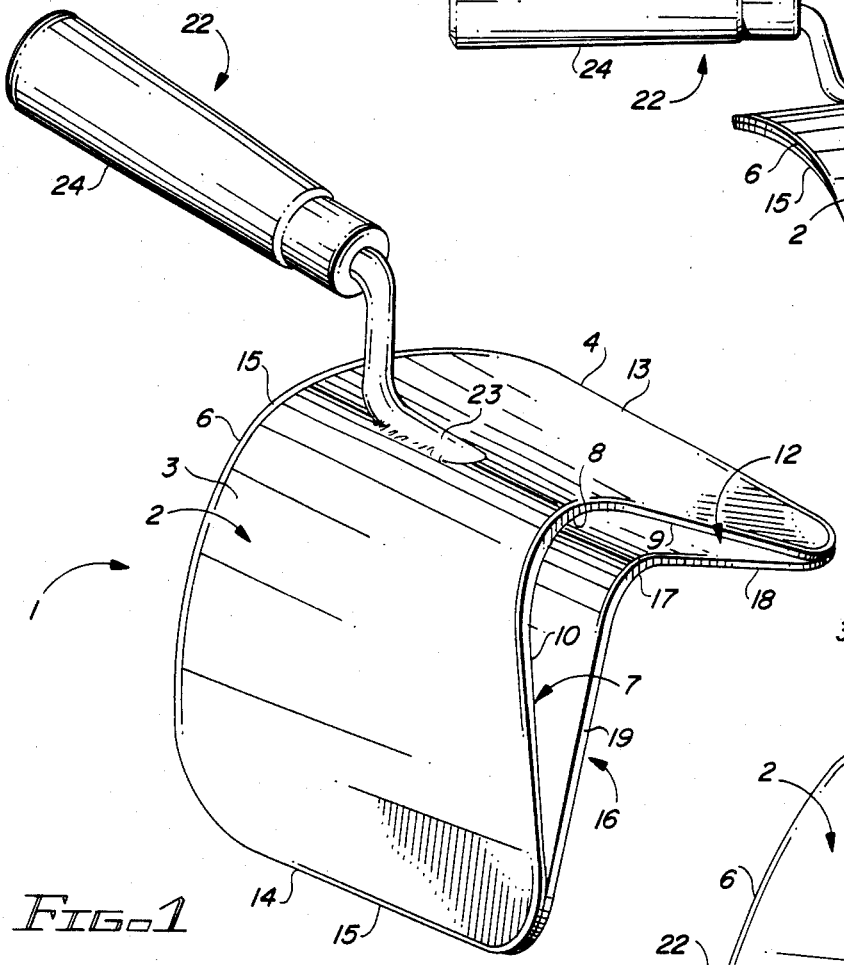
FIG. 1
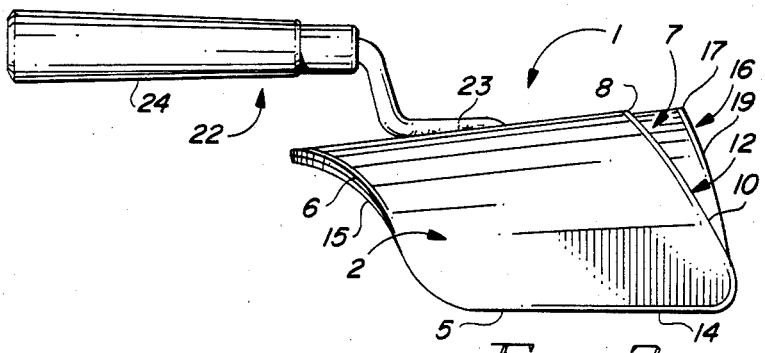
FIG. 2
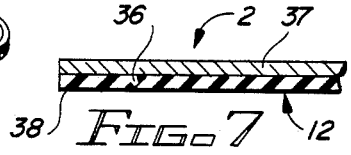
FIG. 7
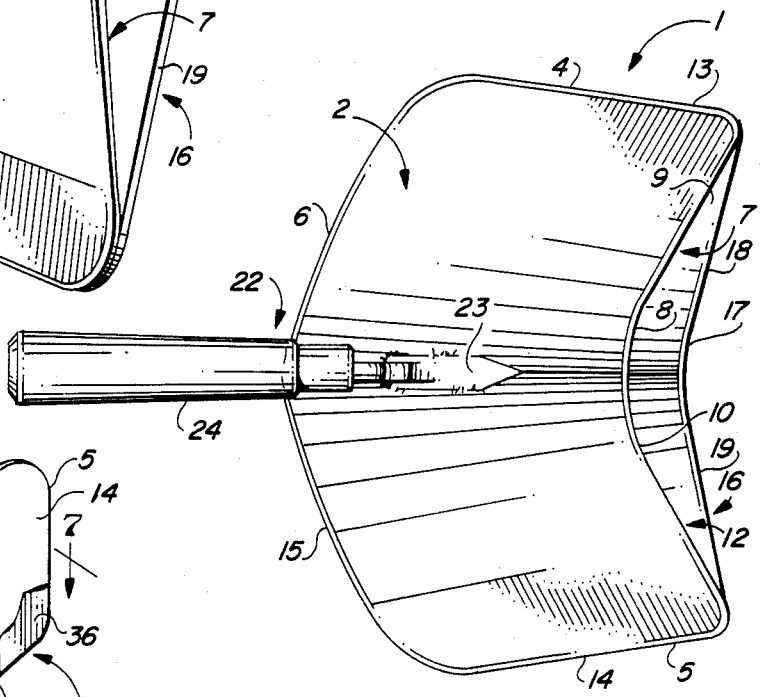
FIG. 3
FIG. 4
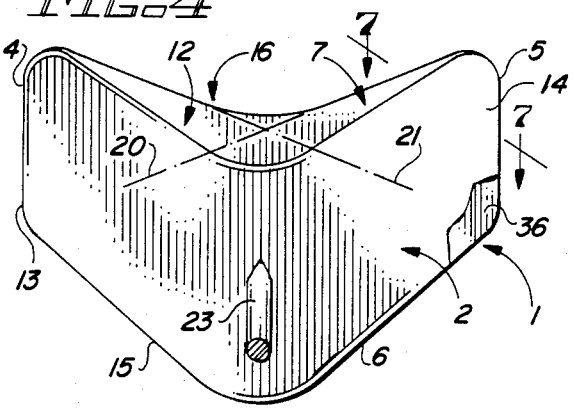
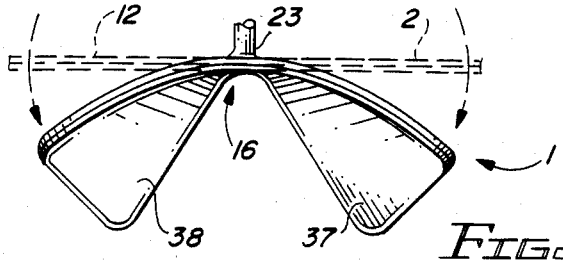
FIG. 5
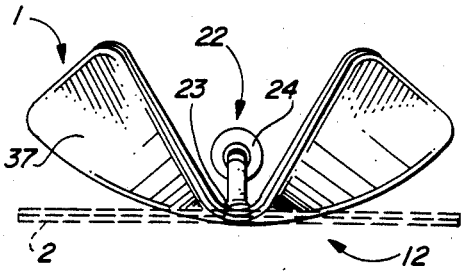
FIG. 6

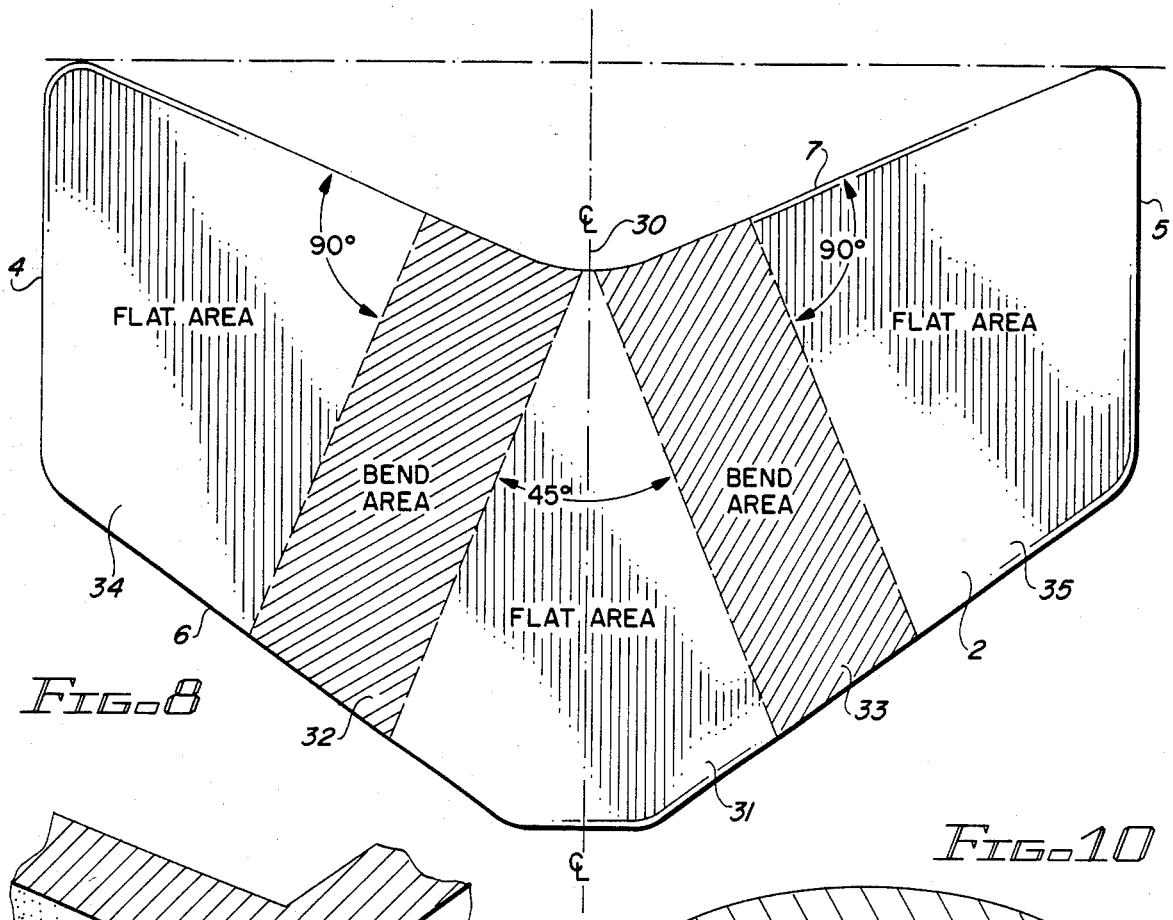
FIG. 8
FIG. 10
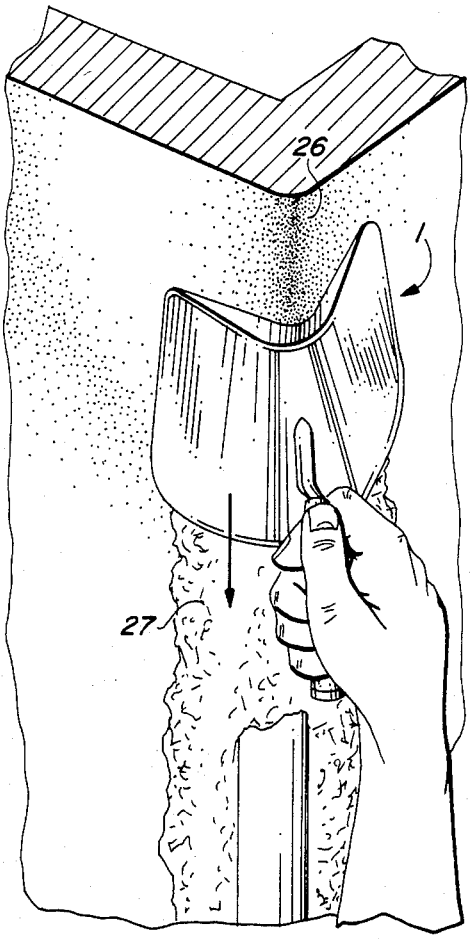
FIG. 9
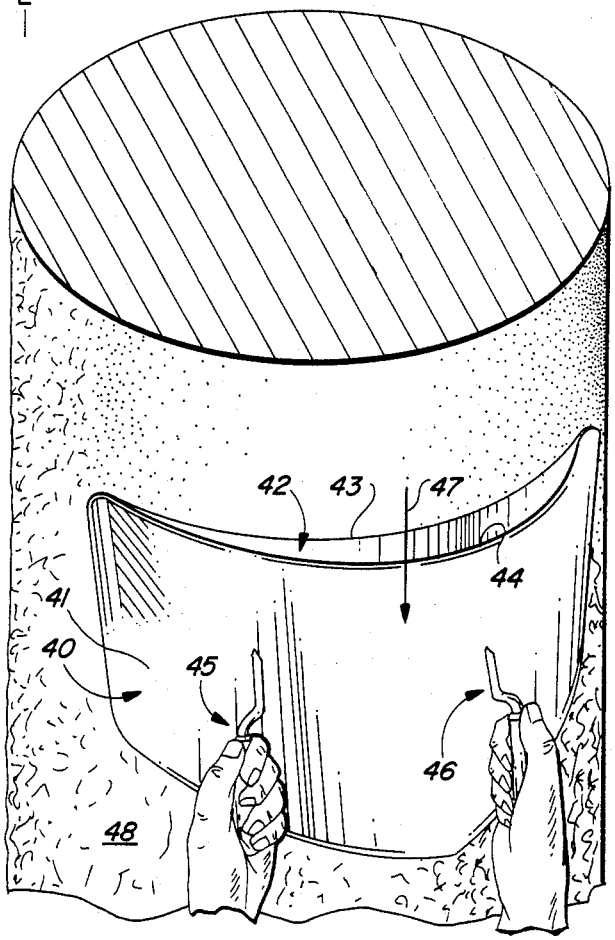

HAND TOOL FOR FINISHING CORNERS AND THE LIKE WITH A CEMENTIOUS MATERIAL

FIELD OF THE INVENTION

This invention relates to the building construction arts and, more particularly, to a hand tool which is particularly effective in finishing inside and outside corners, edges, and even columns with a cementious material to provide a uniformly rounded configuration.

BACKGROUND OF THE INVENTION

In certain architectural styles, such as the well-known Spanish/Mediterranean styles widely used for both commercial and residential buildings in the southwestern United States, an exterior cementious final coat is employed. The cementious outer layer may be of traditional stucco, adobe or more modern variants. During the finishing process, the corners (whether inside or outside) at which the cementious material is applied are more or less "rounded" to obtain a relatively mechanically strong finish in the corner region and also for purely aesthetic purposes. As to the latter, there has been a tendency to employ somewhat larger radii to achieve a pleasing effect in such substyles as "Santa Fe".

Similarly, the interior walls of structures have corners which may be finished with such broadly defined cementious materials as plaster, a plaster substitute, drywall finishing compound, etc. and in which, again, a rounded (i.e., "radiused") effect is sought. As to the use of radiused corners in building interiors, such use is not at all restricted to buildings in which cementious outer finishes are employed, but, in fact enjoys wide appreciation in all types of building construction.

As those skilled in the art will readily understand, achieving a uniformly radiused finish, whether within or without a building and whether an inside corner, outside corner, edge, etc., the finishing technique is extraordinarily difficult to achieve and requires great skill on the part of the workman. As the radii become larger than a fraction of an inch, the skilled workman must devise a tool to assist him in obtaining the desired uniform result. In some instances, trowels have been reshaped to have working edges somewhat conforming to the desired radius. Other expedients have included undertaking to maintain the curvature of a bent piece of cardboard to the desired radius as it is drawn along the region to be radiused. Neither of these approaches has been particularly successful. In both instances, the tool must be carefully held at an appropriate angle throughout the finishing process along the entire length of a corner or the like to be finished; further, the same angle must be carefully maintained from corner to corner. If it is not, the radius achieved will not be the same from point to point, and the resulting finish will not be satisfactory. Further, in the case of the cardboard tool expedient, it lacks sturdiness and is difficult to hold.

Therefore, those skilled in the art will appreciate that it would be highly desirable to provide a special tool for finishing corners, edges and the like with a cementious material which will greatly facilitate the efficiency and uniformity by which such corners, edges and the like may be finished with a cementious material in a radiused configuration; and it is to this end that the present invention is directed.

OBJECTS OF THE INVENTION

It is therefore a broad object of my invention to provide an improved hand tool for applying cementious materials to corners, edges, and the like to obtain a uniformly radiused finish.

It is another object of my invention to provide such a tool which is less demanding than the prior art tools upon the skill of the workman to achieve acceptably uniform results.

It is a still further object of my invention to provide such a hand tool which permits the skilled workman to delicately adjust the tool and hence the results obtained by its use to achieve the desired finish.

SUMMARY OF THE INVENTION

These and other objects of my invention are achieved by providing a hand tool having a backing plate and a pliable sheet overlaying the backing plate to obtain a working surface. The backing plate and the pliable sheet each have forwardly disposed working edges included an indented central portion and left and right outwardly extending leg portions forming obtuse angles. However, the pliable sheet working edge has a shallower angle and therefore extends forwardly of the backing plate working edge to provide a working zone of graduated pliability. The backing plate is preferably fabricated from a material which is manually bendable but which will maintain its shape during the course of normal use of the tool. As a result, the individual workman can reconfigure his tool to the requirements of a given job and to his own technique. A suitable material for the backing plate is cold rolled mild or tool steel having a gauge in the range of 18 to 20. A suitable material for the pliable sheet is 1/16 inch thick neoprene.

DESCRIPTION OF THE DRAWING

The subject matter of the invention is particularly pointed out and distinctly claimed in the concluding portion of the specification. The invention, however, both as to organization and method of operation, may best be understood by reference to the following description taken in conjunction with the subjoined claims and the accompanying drawing of which:

FIG. 1 is a three-quarter perspective view of the subject tool illustrated as configured for finishing a typical outside corner;

FIG. 2 is a side view of the tool configured as in FIG. 1;

FIG. 3 is a top plan view of the tool configured as in FIG. 1;

FIG. 4 is a top plan view of the tool, with the handle removed for clarity, illustrating a basic configuration prior to a bending operation;

FIG. 5 illustrates the manner in which the tool shown in FIG. 4 may be manually configured to establish an appropriate shape for finishing an outside corner;

FIG. 6 illustrates the manner in which the tool shown in FIG. 4 may be manually configured to establish an appropriate shape for finishing an inside corner;

FIG. 7 is a partial cross-sectional view taken along the lines 7—7 of FIG. 4 and illustrating the relationship between the two laminae of the tool construction;

FIG. 8 illustrates a generally preferred shape for a backing plate principal component of the tool;

FIG. 9 illustrates a typical use of the tool in finishing an outside corner with cementious material; and FIG. 10 illustrates a very much larger version of the tool for handling large radius jobs and particularly illustrating the use of two handles which permit a craftsman to use both hands in employing the tool.

DETAILED DESCRIPTION OF THE INVENTION

Referring first to FIGS. 1, 2 and 3, there are shown three views of the subject tool 1 as it has been manually configured to (merely by way of example) be used to finish an outside corner having an exemplary radius on the order of one inch. It will be observed that the tool 1 consists of three principal elements. A backing plate 2 is provided with a back face 3, an opposite front face (which is out of view in FIGS. 1, 2 and 3), left and right edges 4, 5, respectively, a rear edge 6, and a forward working edge 7. The forward working edge 7 of the backing plate 2 is particularly characterized by an indented central portion 8 and left and right leg portions 9, 10, respectively, which form a first obtuse angle and terminate, respectively, at forward ends of the left 4 and right 5 edges of the backing plate 2.

Completely overlaying the front face of the backing plate 2 is a pliable sheet 12 (the second principal element) which is preferably adhesively bonded directly to the backing plate. Thus, left and right edges 13, 14, respective, and a rear edge 15 of the pliable sheet 12 are more or less co-terminus with the corresponding edges 4, 5, 6 of the backing plate 2. However, a forward working edge 16 of the pliable sheet 12 extends forwardly beyond the forward working edge 7 of the backing plate 2. The forward working edge 16 of the pliable sheet 12 has a broadly curved indented central portion 17 and left and right leg portions 18, 19, respectively, forming a second obtuse angle terminating, at front ends of the left and right edges, 13, 14, respectively, of the pliable sheet 12. It will be seen that, with this general geometrical configuration, the second obtuse angle of the forward working edge 16 of the pliable sheet 12 must be a larger angle than the corresponding obtuse angle described by the legs 9, 10 of the forward working edge 7 of the backing plate 2. If (as shown in FIG. 4) the indented central portion is curved throughout its width, the legs 18, 19 may simply be tangents 20, 21 taken at the same distance from the tool centerline as the junctions of the legs 9, 10 with the indented central portion 8 of the backing plate 2.

The third principal element of the tool is a handle 22 affixed (as by welding) to the backing plate 2 in the central region 23 and having a grasping portion 24 extending generally rearwardly and beyond the rear edge 6 of the backing plate 2. The handle 22 is more or less aligned with the respective indented portions 8, 17 of the backing plate 2 and pliable sheet 12.

When the tool 1 has been manually configured (as by bending) for finishing outside corners within the radius range selected by the craftsman, it will be appreciated that there are three different curvatures that come into play during its use. First, there is the "hard" curvature of the forward working edge 7 of the backing plate 2. Second, there is the curvature obtained by the specific bends applied to the backing plate 2. Third, there is the curvature obtained by the forward working edge 16 of the pliable sheet 12 extending forwardly of the forward working edge 7 of the backing plate 2. This last curvature may be deemed to be somewhat adjustable during actual use of the tool in that various pressures and angles at which the tool is held will result in more or less flexing of the pliable sheet 12 in the region which is not rigidly juxtaposed by the backing plate 2.

Thus, as shown in FIG. 9, an outside corner generally indicated at 26 may be uniformly radiused as desired by the craftsman by employing the tool 1 at such an angle and with such a pressure as to facilitate the result sought by that given workman in uniformly working cementious material 27 into the configuration of the corner 26 by drawing the tool downwardly and forming the corner radius by the combined effects of the previously mentioned three curvatures. It will be apparent that there is a certain amount of art and skilled required by the craftsman to take advantage of the capacity of the tool. A fundamental feature of the tool is that, as a result of its configuration in the working region and its capacity to be shaped as an individual craftsman may prefer, the skill and artistry of the craftsman can be fully accommodated on an individual basis.

Consider now in addition detail the construction of the tool. FIG. 8 illustrates the backing plate 2 after it has been cut, stamped, or otherwise formed from a sheet of relatively rigid, but manually bendable material. The character of the material from which the backing plate 2 is formed must be such that, while manually bendable, the tool will maintain its shape during the normal course of use to form and finish corners and edges of a structure with a cementious material. For example, two suitable materials are cold rolled mild steel and tool steel having a gauge in the range 18 to 20. The mild steel is somewat more easily bent while the tool steel is somewhat springier in use. The backing plate 2 illustrated in FIG. 8 has the previously mentioned left and right edges 4, 5, respectively, rear edge 6 and forward working edge 7. Before bending, the backing plate 2 is generally symmetrical about a fore and aft center line 30. The handle 22 (FIGS. 1, 2, 3) is disposed generally in alignment with the center line 30.

The backing plate 2 may be very roughly divided into a central flat area 31, left and right intermediate bend areas 32, 33, respectively, and left and right flat areas 34, 35, respectively. It will be appreciated, however, that these areas are only exemplary and that the final decision as to the appropriately bent configuration is left to the individual craftsman addressing an individual job. Thus, referring to FIGS. 4 and 5 which also illustrate the pliable sheet 12 affixed with its back face 36 completely overlaying the front face 37 of the backing plate 2 (FIG. 5) with its working edge 16 extending forwardly of the working edge 7 of the backing plate. As best shown in FIG. 5, the individual craftsman may manually bend the backing plate 2 more or less symmetrically downwardly away from the original plane of the backing plate to achieve a configuration suitable for an outside corner in a given radius range. The degree of the bends and their precise location are the choice of the craftsman.

Similarly, as shown in FIG. 6, the backing plate 2 may be bent more or less symmetrically upwardly from the original plane of the backing plate 2 in order to obtain a configuration appropriate for finishing inside corners with cementious material within a predetermined radius range.

FIG. 7 illustrates the laminar relationship of the backing plate 2 and the pliable sheet 12. More particularly, the front face 37 of the backing plate 2 and the rear face 36 of the pliable sheet 12 are firmly fixed together as by using any suitable adhesive. The front face 38 of the pliable sheet 12 constitutes the tool working surface which serves to spread and guide the cementious material into place as the tool is drawn along the region of a corner to be finished.

Use of the tool is not limited to symmetrical bends or even a fully symmetrical configuration as shown in FIG. 8. An individual craftsman may wish, for example, to bend one side only in order to finish a particularly difficult corner which may have, by way of example, a small radius. Similarly, a tool configuration actually having a truncated side to achieve a "bullnose" configuration permits the finish of corners closely adjacent structures (such as windows) which will not accommodate, on one side, the full half-width of the tool. Such asymmetrical configuration may be either "left handed" or "right handed" according to the preferences of the craftsman.

The tool as so far described is especially useful in finishing corners in the ⅛ inch–4 inch radius range. For that range, the backing plate 2 may be on the order of eight inches wide from the left edge 4 to the right edge 5 with the remaining dimensions roughly proportional as shown in the figures. These dimensions are not critical, but the obtuse angle between the legs 18, 19 of the leading edge 16 of the pliable sheet 12 must be sufficiently shallower than the corresponding angle between the legs 9, 10 of the forward working edge of the backing plate 2 as to provide a distance of about one inch between the central portion 8 of the working edge 7 and the central portion 17 of the working edge 16.

Some architectural styles, particularly for exteriors, require very large radius corners or even columns, and FIG. 10 illustrates a variant embodiment of the tool which is especially adapted to use in finishing such large radius jobs. To accommodate larger radii, such as those used in the "adobe" finish, Santa Fe style architecture, a physically larger, but otherwise proportionate, tool may be employed. More particularly, the tool variant 40 is very much larger than the previously discussed tool 1. However, it is similarly characterized by a manually bendable backing plate 41 and a pliable sheet 42 having a forward working edge 43 extending forwardly beyond the forward working edge 44 of the backing plate 41. The curve of the pliable sheet working edge 43 is shallower than the curve of the backing plate working edge 44 to provide the effect previously described. Because of the much larger size of the tool variant 40, a pair of handles 45, 46 are symmetrically disposed about the center line of the tool 41 in order that the workman may grasp them and manipulate the tool with both hands by pulling it downwardly in the direction indicated by the arrow 47 to form the cementious material 48 into the desired radius such as that of exemplary column 49.

While the principles of the invention have now been made clear in illustrative embodiments, there will be immediately obvious to those skilled in the art many modifications of structure, arrangements, proportions, the elements, materials, and components, used in the practice of the invention which are particularly adapted for a specific environment and operating requirements without departing from those principles.

I claim:

1. A hand tool for forming and finishing corners and edges of a structure with a cementious material, said hand tool comprising:

(A) a backing plate having front and back faces, left an right side edges, a forward working edge and a rear edge;

(B) a handle affixed to said back face of said backing plate, said handle extending generally rearwardly and beyond said rear edge of said backing plate;

(C) said working edge of said backing plate having a configuration including an indented central portion and left and right leg portions, said leg portions forming a first obtuse angle and terminating, respectively, at forward ends of said left and right edges of said backing plate;

(D) a pliable sheet having front and back faces, left and right edges, a forward working edge and a rear edge;

(E) said back face of said pliable sheet overlaying and affixed to said front face of said backing plate;

(F) said working edge of said pliable sheet having a configuration including an indented central portion and left and right leg portions forming a second obtuse angle terminating, respectively, at forward ends of said left and right edges of said pliable sheet; and (G) said second obtuse angle being greater than said first obtuse angle;

whereby said working edge of said pliable sheet extends forwardly beyond said working edge of said backing plate.

2. The hand tool of claim 1 in which said backing plate is fabricated from a material which is manually bendable, but which will maintain its shape during the course of normal use of the tool to form and finish corners and edges of a structure with a cementious material.

3. The hand tool of claim 2 in which said backing plate is fabricated from cold rolled mild steel having a gauge in the range 18 to 20.

4. The hand tool of claim 2 in which said backing plate is fabricated from tool steel having a gauge in the range 18 to 20.

5. A hand tool for forming and finishing relatively large radius columns, corners and edges of a structure with a cementious material, said hand tool comprising:

(A) a backing plate having front and back faces, left and right side edges, a forward working edge and a rear edge;

(B) a pair of spaced apart handles affixed to said back face of said backing plate;

(C) said working edge of said backing plate having a configuration including an indented central portion and left and right leg portions, said leg portions forming a first obtuse angle and terminating, respectively, at forward ends of said left and right edges of said backing plate;

(D) a pliable sheet having front and back faces, left and right edges, a forward working edge and a rear edge;

(E) said back face of said pliable sheet overlaying and affixed to said front face of said backing plate;

(F) said working edge of said pliable sheet having a configuration including an indented central portion and left and right leg portions forming a second obtuse angle terminating, respectively, at forward ends of said left and right edges of said pliable sheet; and (G) said second obtuse angle being greater than said first obtuse angle;

whereby said working edge of said pliable sheet extends forwardly beyond said working edge of said backing plate and whereby said tool may be manipulated by a workman using both hands on the said two handles.

6. The hand tool of claim 5 in which said backing plate is fabricated from a material which is manually bendable, but which will maintain its shape during the course of normal use of the tool to form and finish corners and edges of a structure with a cementious material.

7. The hand tool of claim 6 in which said backing plate is fabricated from cold rolled mild steel having a gauge in the range 18 to 20.

8. The hand tool of claim 6 in which said backing plate is fabricated from tool steel having a gauge in the range 18 to 20.

9. The hand tool of claim 1 in which said left and right legs of said forward working edge of said pliable sheet are tangents taken therefrom at the same distances from a fore and aft centerline of said tool as the distances to the respective junctions of said left and right legs of said forward working edge of said backing plate with said indented central portion of said forward working edge of said backing plate.

10. The hand tool of claim 5 in which said left and right legs of said forward working edge of said pliable sheet are tangents taken therefrom at the same distances from a fore and aft centerline of said tool as the distances to the respective junctions of said left and right legs of said forward working edge of said backing plate with said indented central portion of said forward working edge of said backing plate.

* * * * *